US008776839B2

(12) United States Patent
Clusserath et al.

(10) Patent No.: US 8,776,839 B2
(45) Date of Patent: Jul. 15, 2014

(54) FILLING ELEMENT AND FILLING MACHINE FOR FILLING BOTTLES OR SIMILAR CONTAINERS

(75) Inventors: Ludwig Clusserath, Bad Kreuznach (DE); Manfred Hartel, Bretzenheim (DE)

(73) Assignee: KHS GmbH, Dortsmund (DE)

( * ) Notice: Subject to any disclaimer, the term of this patent is extended or adjusted under 35 U.S.C. 154(b) by 0 days.

(21) Appl. No.: 13/643,186

(22) PCT Filed: Apr. 8, 2011

(86) PCT No.: PCT/EP2011/001756
§ 371 (c)(1), (2), (4) Date: Oct. 24, 2012

(87) PCT Pub. No.: WO2011/154068
PCT Pub. Date: Dec. 15, 2011

(65) Prior Publication Data

US 2013/0037168 A1 Feb. 14, 2013

(30) Foreign Application Priority Data

Jun. 8, 2010 (DE) ..... 10 2010 022 985

(51) Int. Cl.
*B67C 3/06* (2006.01)

(52) U.S. Cl.
CPC ..... *B67C 3/06* (2013.01)
USPC ..... 141/48; 141/63; 141/39; 141/302; 141/50; 141/47; 141/6

(58) Field of Classification Search
CPC ..... B67C 3/06; B67C 3/10; B67C 3/12
USPC ..... 141/4–6, 37, 39, 47–49, 52, 59, 63
See application file for complete search history.

(56) References Cited

U.S. PATENT DOCUMENTS 2,728,511 A * 12/1955 Breeback ..... 141/54
3,252,486 A * 5/1966 Mallrich ..... 141/50
3,604,480 A * 9/1971 Reichert et al. ..... 141/39

(Continued)

FOREIGN PATENT DOCUMENTS

DE 2123865 A1 * 11/1972
DE 7238224 U * 8/1973

(Continued)

*Primary Examiner* — Timothy L Maust
*Assistant Examiner* — Robert Bell, III
(74) *Attorney, Agent, or Firm* — Occhiuti & Rohlicek LLP

(57) ABSTRACT

A filling element for filling containers includes a housing having a liquid channel, a connection for feeding liquid into the channel, a discharge port for discharging liquid into a container provided in a sealed position on the filling element, a valve in the channel between the connection and the port, an actuator for opening and closing the channel, a gas path for pre-stressing the container's interior with gas and returning displaced gas, a switching valve in the gas path, the valve being switchable by the actuator between a first state for use while pre-stressing and a second switched state for use with displaced gas, wherein in the first state, the gas path has a first effective flow cross section, and in the second state, the gas path has a second effective flow cross section, the second effective flow cross section being different from the first effective flow cross section.

10 Claims, 4 Drawing Sheets

(56) References Cited

U.S. PATENT DOCUMENTS

| | | | | | |
|---|---|---|---|---|---|
| 3,834,428 | A | | 9/1974 | Rademacher | |
| 4,307,762 | A | * | 12/1981 | Mette | 141/284 |
| 4,363,339 | A | | 12/1982 | Puskarz | |
| 4,644,981 | A | * | 2/1987 | Bernhard | 141/39 |
| 4,679,603 | A | * | 7/1987 | Rademacher et al. | 141/39 |
| 4,976,295 | A | * | 12/1990 | Clusserath | 141/39 |
| 4,986,318 | A | * | 1/1991 | Yun | 141/39 |
| 5,040,574 | A | * | 8/1991 | Petri et al. | 141/39 |
| 5,082,033 | A | * | 1/1992 | Weiss | 141/39 |
| 5,377,726 | A | * | 1/1995 | Clusserath | 141/39 |
| 5,413,153 | A | * | 5/1995 | Zwilling et al. | 141/39 |
| 5,558,135 | A | * | 9/1996 | Kronseder et al. | 141/6 |
| 5,634,500 | A | * | 6/1997 | Clusserath et al. | 141/48 |
| 5,640,993 | A | * | 6/1997 | Kasugai et al. | 137/587 |
| 6,112,780 | A | * | 9/2000 | Meheen | 141/40 |
| 8,381,777 | B2 | * | 2/2013 | Lupi et al. | 141/48 |
| 2007/0113917 | A1 | * | 5/2007 | Stavrakis et al. | 141/39 |

FOREIGN PATENT DOCUMENTS

| | | | | |
|---|---|---|---|---|
| DE | 22 60 063 | | | 6/1974 |
| DE | 75 36 390 | | | 4/1976 |
| DE | 38 21 052 | | | 1/1989 |
| DE | 3725609 | A1 | * | 2/1989 |
| DE | 3829081 | A1 | * | 3/1989 |
| DE | 4311202 | C1 | * | 10/1994 |
| EP | 0 582 190 | | | 2/1994 |

* cited by examiner

FILLING ELEMENT AND FILLING MACHINE FOR FILLING BOTTLES OR SIMILAR CONTAINERS

CROSS REFERENCE TO RELATED APPLICATION

This application is the national phase under 35 USC 371 of international application no. PCT/EP2011/001756, filed Apr. 8, 2011, which claims the benefit of the priority date of German application no. 10 2010 022 985.7, filed Jun. 8, 2010. The contents of the aforementioned applications are incorporated herein in their entirety.

FIELD OF DISCLOSURE

The invention relates to a filling element as well as to a filling machine.

BACKGROUND

Filling elements and filling machines for filling bottles or similar containers, in particular also for pressure-filling, are known in different embodiments.

For the purpose of the invention, the term "pressure-filling" is to be understood generally to mean a filling method wherein before the actual filling phase, i.e. before the opening of the liquid valve, the respective container that is to be filled and that lies with its container mouth in sealed position against the filling element is pre-stressed with a pressurised pressure gas (inert gas or CO2 gas) which the filling material flowing to the container then increasingly displaces as return gas from the container interior during filling.

For the purpose of the invention, "container in sealed position with the filling element" means that the respective container that is to be filled lies in the manner known to the skilled person with its container mouth pressed seal-tight against the filling element or against a seal at that location which encircles the at least one discharge port.

In the case of known filling elements, the pressure gas is delivered to the respective container and the return gas is taken away from the respective container over one and the same controlled gas path configured in the filling element, i.e. over a gas path in which a control valve is disposed. This is then for example part of a pneumatic control valve array and is controlled by at least one electrically controllable switching valve of a machine controller of the filling machine.

In order among other things to increase the output of a filling machine (number of filled containers per unit of time) while maintaining the gentle filling of the containers, it would make sense if the effective flow cross-section of the gas path for the pressure gas were greater than the effective flow cross-section of the gas path for the return gas, since on the one hand the time (cycle time) for pre-stressing can be reduced and on the other hand a filling speed that is optimum for gentle filling can be achieved in this way. For the purpose of the invention, "effective flow cross-section" means that flow cross-section which the respective gas path exhibits overall and which is essentially determined by the section (gas path section) of the gas path having the smallest cross-section.

This requirement for a larger effective flow cross-section for the pressure gas and at the same time for a reduced effective flow cross-section for the return gas cannot be satisfied by a single control valve in the common gas path for the pressure gas and the return gas.

Instead this would require at least two control valves with associated electrical switching valve, and this would mean a considerable complexity in terms of both design and in particular of circuit engineering and control engineering.

SUMMARY

The task of the invention is to provide a filling element which with little additional design complexity facilitates different flow cross-sections for the pressure gas and the return gas with no additional complexity in terms of circuit engineering and control engineering.

A peculiarity of the invention consists generally in the fact that in the common gas path—which may also be bifurcated for example—for the pressure gas and the return gas a switching valve is provided which in a first switched state brings about a first effective flow cross-section, for example the greater effective flow cross-section of the gas path for the pressure gas, and in a second switched state brings about a second, smaller than the first, effective flow cross-section of the gas path, for example for the return gas. The switching valve is switched by a drive or mechanically, preferably via a valve stem of the liquid valve or via a valve tube or gas tube, by the actuator of the liquid valve, and exhibits the first switched state for example when the liquid valve is closed and the second switched state for example when the liquid valve is open. The switching valve can be realised in a relatively simple way while retaining the proven design of the filling element.

Further embodiments, advantages and possible applications of the invention arise out of the following description of embodiments and out of the figures. All of the described and/or depicted attributes whether alone or in any desired combination are fundamentally the subject matter of the invention independently of their synopsis in the claims or a retroactive application thereof. The content of the claims is also made an integral part of the description.

BRIEF DESCRIPTION OF THE FIGURES

The invention is explained in detail below through the use of embodiment examples with reference to the figures. In the figures.

DETAILED DESCRIPTION

Figure 1:
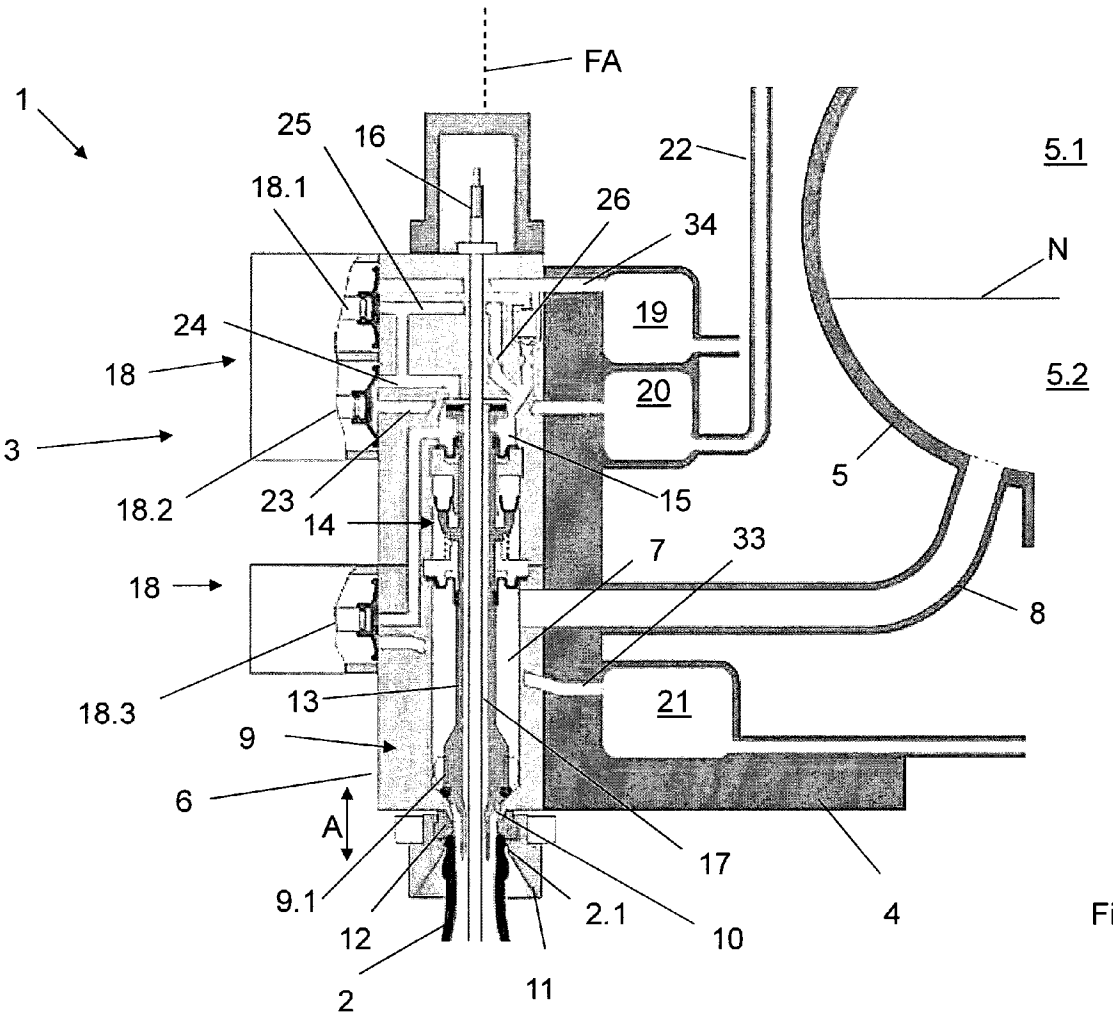
FIG. 1 shows in simplified partial representation a filling system according to the invention, together with a bottle raised in sealed position against the filling element of this system.

The filling system indicated generally in FIG. 1 by 1 is part of a rotary-type filling machine for filling a liquid filling material into bottles 2 or similar containers. To this end, filling system 1 consists among other things of filling elements 3, of which only one filling element 3 is shown in FIG. 1 and which are provided at equal angular distances about the periphery of a rotor 4 of the filling machine which (rotor) can be driven to rotate about a vertical machine axis. On the only partially depicted rotor 4 is disposed a tank 5 common to all filling elements 3 and which is configured for example as an annular tank and which during the filling operation is partly filled with the filling material up to a predetermined level N by way of level control. During the filling operation therefore, tank 5 is occupied by an upper gas space 5.1 and a lower liquid space 5.2. If filling system 1 is used for pressure-filling the liquid filling material into the containers or bottles 2, then gas space 5.1 is filled under pressure-control with an inert gas (CO2 gas) which is at a filling pressure. The liquid filling material is fed under control to tank 5 over a supply line which is not shown.

In a housing 6 of filling element 3 there is configured among other things a liquid channel 7 which is connected via a line 8 to liquid space 5.2 of tank 5. In liquid channel 7 there is provided a liquid valve 9 for the controlled delivery of the liquid filling material across an annular discharge port 10 which concentrically encircles a vertical filling element axis FA and which is formed on the underside of filling element 3 by the local open end of liquid channel 7. At discharge port 10 there is provided a centering tulip 11 with seal 12 which annularly encircles discharge port 10 and against which respective bottle 2 lies pressed with its bottle mouth 2.1, i.e. in sealed position, during the filling, in particular also during the pressure-filling.

Liquid valve 9 consists essentially of a valve body 9.1 which is disposed in liquid channel 7 and which interacts with a valve seat configured on the inner surface of liquid channel 7. In the depicted embodiment, valve body 9.1 is provided or configured on a valve tube or gas tube 13 disposed on the same axis as filling element axis FA and open at both ends and which both acts as a valve stem to actuate liquid valve 9 and for this purpose interacts with an actuator 14 with which gas tube 13 and hence valve body 9.1 can be moved through a predetermined stroke axially on filling element axis FA (double arrow A) to open and close liquid valve 9.

Gas tube 13 protrudes by its lower open end through discharge port 11 and beyond the underside of housing 6 and so during filling extends by that end into the interior of bottle 2. Gas tube 14 extends by its upper, likewise open end into a closed gas space 15. Reference number 16 indicates a probe which is arranged on the same axis as filling element axis FA and which determines the fill height in respective bottle 2, extending through gas tube 13 and protruding by its lower end out of the lower open end of gas tube 13. Between the outer surface of probe 16 and the inner surface of gas tube 13 there is configured an annular gas channel 17 which is open at the lower end of gas tube 13 and which at the upper end of gas tube 13 is connected to gas space 15 in the manner described in more detail below.

Gas space 15 configured inside housing 6 is part of a gas path system or gas channel system which exhibits a plurality of controlled gas paths with associated control valves 18.1, 18.2 and 18.3. These control valves 18.1, 18.2 and 18.3 which in the depicted embodiment are pneumatically actuated are part of a control valve array 18 which—as is known to the skilled person—is used to control different filling methods or their process or filling phases, among other things by the controlled connection of gas paths of the gas path system or gas channel system with annular channels 19, 20 and 21 which are provided on rotor 4 for filling elements 3 in common and of which ring channel 20 is connected by a line 22 to gas space 5.1 of tank 1 so that ring channel 20 also carries the pressurised inert gas.

In the case of pressure-filling, before the actual filling phase, at least a pre-stressing of bottles 2 takes place with the pressurised inert gas which when control valve 18.2 is open flows as pressure gas from ring channel 20 across gas space 15 and gas channel 17 into bottle 2 arranged in sealed position at filling element 3. During the subsequent filling phase and in particular during the rapid filling phase when liquid valve 9 is open the inert gas displaced out of the bottle interior by the filling material flowing into bottle 2 is returned as return gas to ring channel 20 through gas channel 17, gas space 5 and open control valve 18.2.

The duration of the pre-stressing of respective bottle 2 is determined among other things by the effective flow cross-section of the gas path through which the pressure gas flows from ring channel 20 into bottle 2. The filling rate or flow rate at which the liquid filling material flows through discharge port 10 during the filling phase and in particular during the rapid filling phase of respective bottle 2 is determined among other things by the height of the filling material level N in tank 5 and by the effective flow cross-section of the gas path through which the return gas passes to ring channel 20. To achieve a highest possible output of the filling system (number of filled bottles per unit of time) while still maintaining a gentle filling of bottles 2 with the liquid filling material, it is among other things a requirement for the gas path for the pre-stressing of respective bottle 2 with the pressure gas or inert gas from ring channel 20 to exhibit the greatest possible effective flow cross-section so as to achieve short cycle times for the pre-stressing, while the gas path for the return gas should exhibit a reduced effective flow cross-section during the filling phase and in particular also during the rapid filling phase. To satisfy these requirements without an additional control valve of control valve array 18 and without involving additional attendant complexity in terms of design and/or circuitry engineering and/or control engineering, filling element 3 is provided among other things with two different gas paths for the pre-stressing and the filling/rapid filling which share a single control valve 18.2. For this purpose control valve 18.2 is connected on its input side to ring channel 20 via a gas channel 23 and on its output side to gas space 15 via a gas channel 24 and a further parallel gas channel 25 with throttle 26. The different gas paths formed for the pressure gas and the return gas by gas channels 24 and 25 are mechanically switched in the manner described below by actuator 14 of liquid valve 9, i.e. in the depicted embodiment by gas tube 13 together with the opening and closing of liquid valve 9.

Figure 2:
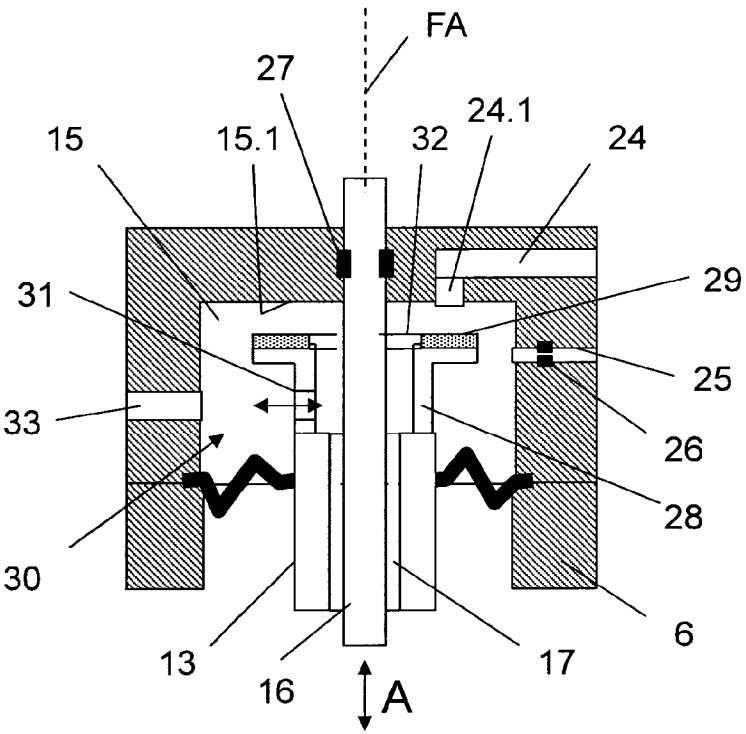

Gas space 15 is schematically depicted in more detail in FIG. 2. Also depicted are in particular probe 16 which is extended out of gas space 15 and sealed at the top with the use of a seal 27 as well as the two gas channels 24 and 25 opening into gas space 15, with the throttle 26 being in gas channel 25.

The upper end of gas tube 13 is provided with an annular body 28 which encircles probe 16 concentrically and at a distance and which has a flange projecting radially away over the outer surface of the annular body at the top of the annular body, on which (flange) is attached a ring seal 29 encircling probe 16 concentrically and at a distance. When liquid valve 9 is closed, i.e. when gas tube 13 is lowered, ring seal 29 is spaced at a distance from inner surface 15.1 of gas space 15 which (inner surface) lies axially opposite it relative to filling element axis FA, and from mouth 24.1 of gas channel 24. When liquid valve 9 is open, ring seal 29 lies against inner surface 15.1 in the region of mouth 24.1 and sealing the latter tight. In interaction with inner surface 15.1 which encircles mouth 24.1, annular body 28 with seal 29 therefore forms a switching valve 30 which when liquid valve 9 is closed mouth 24.1 is open to gas space 15.

When liquid valve 9 is closed and control valve 18.2 is open therefore there exists for the pressure gas during pre-stressing a gas path with a large flow cross-section out of ring channel 20 and through gas channel 24, gas space 15, the interior of annular body 28 which (interior) is open to gas space 15 across radial ports 31, and across an end port 32, and gas channel 17 which connects with the interior of annular body 28.

When liquid valve 9 is open and control valve 18.2 is closed, i.e. during filling, in particular during rapid filling, there therefore exists for the return gas only a gas path with reduced flow cross-section into ring channel 20, across gas channel 17, radial ports 31 in annular body 28, gas space 15 and gas channel 25 with throttle 26 which now determines or essentially determines the effective reduced flow cross-section of this gas path.

The embodiment of switching valve 32 depicted in FIG. 2 also has particular advantages for a CIP cleaning of filling elements 3 because during this cleaning, a flow connection with a relatively large cross-section exists for the cleaning and/or sterilisation medium that is used between gas channel 17 and gas space 15 through ports 31 when liquid valve 9 is open.

Figure 3:
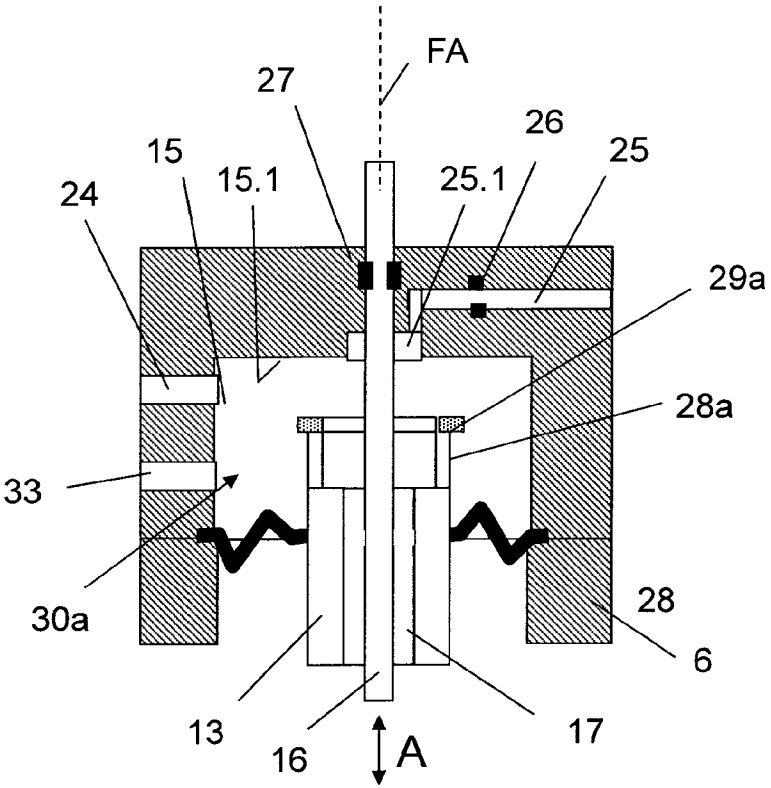
FIGS. 2 and 3 each show in enlarged schematic partial representation a gas space and a switching valve there configured of the filling element of FIG. 1 with two different versions of this valve.

FIG. 3 shows a modified embodiment in which, when liquid valve 9 is open, switching valve 30*a* formed by annular body 28*a* with ring seal 29*a* in interaction with inner surface 15.1 of gas space 15 creates a connection solely between gas channel 17 and gas channel 25 that exhibits throttle 26, whereas when liquid valve 9 is closed, gas channel 17 also connects with gas channel 24. For this purpose mouth 25.1 of gas channel 25 is executed as an annular port encircling probe 16. Gas channel 24 opens out into gas space 15 such that it is always connected to gas space 15 whatever the state of valve 30*a*. Annular body 28*a* exhibits no radial ports in this embodiment.

When liquid valve 9 is closed, valve body 29 is axially spaced from mouth 25.1 relative to filling element axis FA so that during the pre-stressing of respective bottle 2, a flow connection from both gas channels 24 and 25 into gas space 15 and hence into gas channel 17 exists when control valve 18.1 is open. When liquid valve 9 is open, valve body 29 lies tight against the inner surface of gas space 15 surrounding mouth 25.1, so that during the filling phase and in particular also during the rapid filling phase there exists a connection for the return gas from gas channel 17 solely into gas channel 25 with throttle 26.

Reference sign 33 indicates a gas channel in which control valve 18.3 is arranged and which connects gas space 15 to ring channel 21. This gas channel is used for example for relieving pressure in respective bottle 2 after the end of the filling phase, by control valve 18.3 being opened.

Control valve 18.1 is connected on its input side to gas channels 24 and 25 and on its output side via a gas channel 34 to ring channel 19 through which for example at the start of filling an evacuation of respective bottle 2 is effected controlled by control valve 18.1, again across gas space 15, additional switching valve 30 or 30*a* that is opened when the liquid valve 9 is closed, and gas channel 17.

Figure 4:
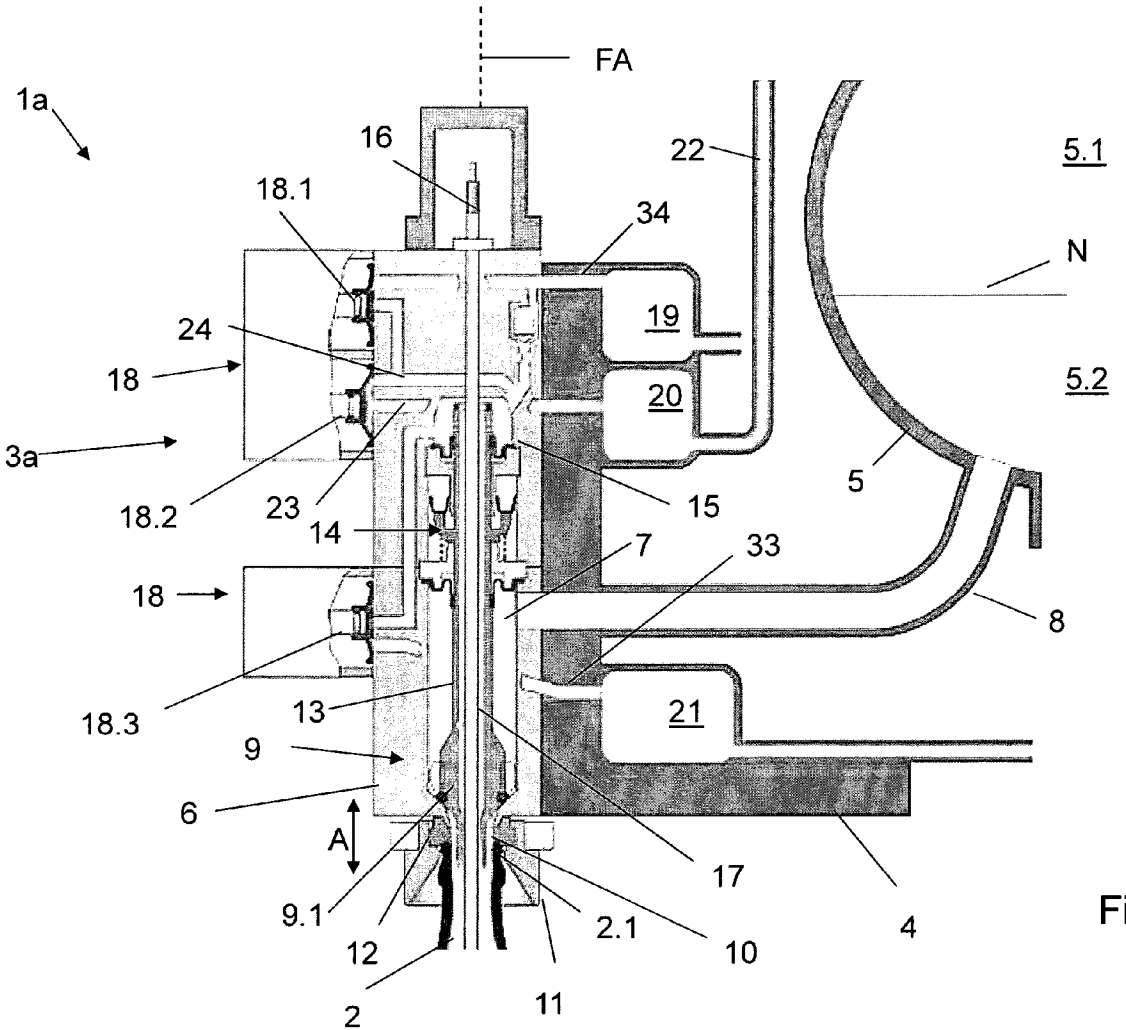
FIG. 4 shows in simplified partial representation a filling system according to the invention, together with a bottle raised in sealed position against the filling element of this system in the case of a further embodiment of the invention.
Figure 5:
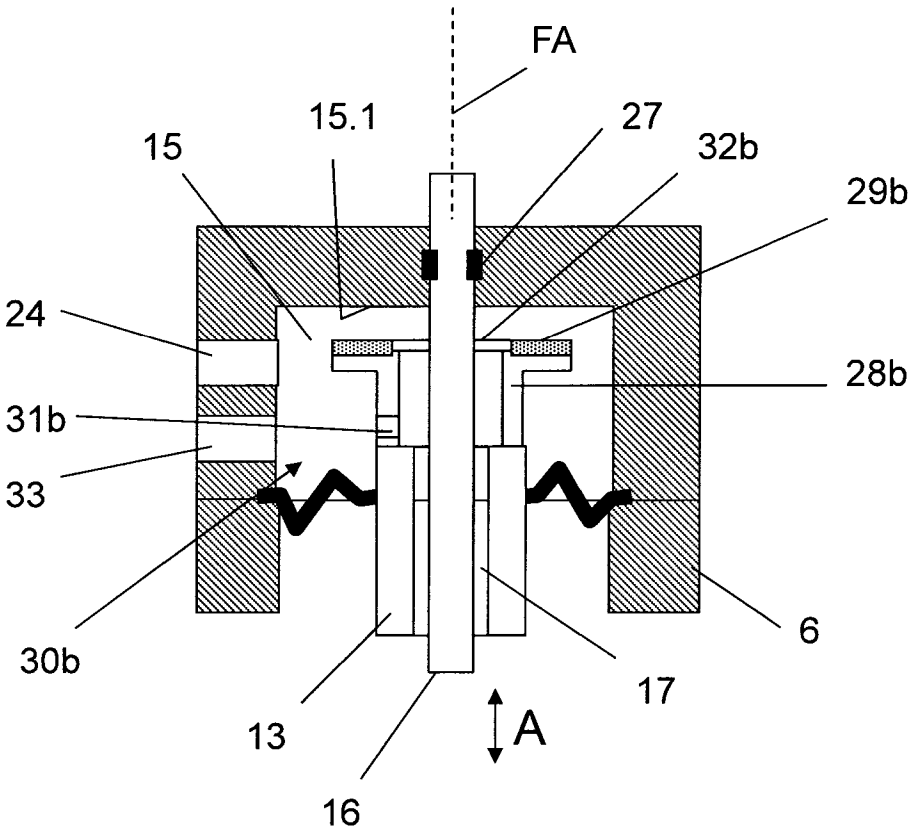
FIG. 5 shows in enlarged schematic partial representation a gas space and a switching valve there configured of the filling element of FIG. 4.

FIG. 4 shows a filling element 3*a* of a filling system 1*a*. Filling element 3*a* differs from filling element 3 only in that the gas channel system in housing 6 does not exhibit gas channel 25 with throttle 26 but instead the restricting of the return gas during the filling phase or rapid filling phase of the filling process is integrated into switching valve 30*b* that corresponds to switching valve 30 or 30*a* (FIG. 5). The components which correspond to filling element 3 in regard to their configuration and/or function are indicated in FIG. 4 with the same reference numbers as in FIG. 1.

FIG. 5 depicts schematically gas space 15 of filling element 3*a*. To form switching valve 30*b*, gas tube 13 is again provided at its upper end which protrudes into gas space 15 with an annular body 28*b* having an end ring seal 29*b* and which concentrically encircles probe 16 at a distance, and in such a way as to create at its end an annular port 32*b* which encircles probe 16 and which is for the interior of annular body 28*b* which connects with gas channel 17. Gas channel 24 opens out into gas space 15 and in such a way that its connection with gas space 15 is independent of the state of switching valve 30*b*. When liquid valve 8 is closed, ring seal 29*b* is at a distance from inner surface 15.1 lying opposite it of gas space 15, so that among other things during the pre-stressing of respective bottle 2, when control valve 18.2 is open, the pressure gas guided out of ring channel 20 across gas channels 23 and 24 into gas space 15 is able to flow across the largest cross-section of port 32*b* into gas channel 17 and hence into bottle 2.

When the liquid valve is closed, seal 29*b* lies tight against inner surface 15.1 so that port 32*b* is closed and it is now only through radial ports 31*b* which are provided in annular body 28*b* and whose total flow cross-section is very much smaller than the flow cross-section of port 32*b* that the return gas can pass at a greatly restricted rate out of gas channel 17 and into gas space 15 from where the return gas is then returned through gas channels 23 and 24 and open control valve 18.2 into ring channel 20.

The invention has been described hereinbefore by reference to embodiments. It goes without saying that numerous variations are possible without departing from the concept underlying the invention.

Common to all embodiments described above is that switching valve 30, 30*a* or 30*b* is mechanically actuated with actuator 14 of liquid valve 9 and is realised with a valve body (annular body 28, 28*a*, 28*b* and seal 29, 29*a* and 29*b* respectively) which is provided on gas tube 13 acting as a valve stem for liquid valve 9, so that a change of the flow cross-section for the pressure gas and the return gas is achieved without any additional control valve which would require additional circuit engineering and control engineering complexity. Other embodiments are of course also possible, in particular those in which the respective annular or valve body of the switching valve is formed by a section of gas tube 13 and/or the annular body or valve body is an element connected to the return gas tube. Moreover the invention is of course not limited to filling elements or filling systems having probes that determine the fill height, but also includes among other things filling elements and filling systems in which the filling material quantity introduced into the respective container is controlled by other means, for example by measuring the delivered filling material quantity and/or the weight of the respective container as it is filled.

LIST OF REFERENCE SIGNS 1, 1*a* Filling system
2 Bottle
2.1 Bottle mouth
3, 3*a* Filling element
4 Rotor
5 Tank
5.1 Gas space
5.2 Liquid space
6 Filling element housing
7 Liquid channel
8 Pipe
9 Liquid valve
9.1 Valve body
10 Discharge port

11 Centering tulip
12 Seal
13 Valve or gas tube
14 Actuator
15 Gas space
15.1 Inner surface
16 Probe
17 Gas channel
18 Control valve device
18.1-18.3 Control valve
19, 20, 21 Ring channel
22 Pipe
23-25 Gas channel
24.1, 25.1 Mouth
26 Throttle
27 Seal
28, 28*a*, 28*b* Annular body
29, 29*a*, 29*b* Ring seal
30,30*a*, 30*b* Switching valve
31, 31*b* Radial port
32, 32*a*, 32*b* Port
33,34 Gas channel
A Movement stroke of the valve body 9.1
N Level of the filling material surface in tank 5
FA Filling element axis

The invention claimed is:

1. An apparatus comprising a filling element for filling containers with a liquid product, said filling element comprising an actuation device, a connection, a controlled gas circuit comprising a closed gas space, a first gas channel section, and a second gas channel section that is separate and distinct from said first gas channel section, a delivery opening, a filling element housing, a fluid channel, a fluid valve, and a switching valve, wherein said fluid channel is formed in said housing, wherein said connection is formed in said housing to supply liquid product to said channel, wherein said delivery opening is connected to said fluid channel for delivering liquid product into a container, wherein said delivery opening is disposed in said fluid channel for delivering said liquid product into a container that is provided at said filling element and that is connected to said filling element in a sealed manner, wherein said fluid valve is disposed within said fluid channel between said connection and said delivery opening, wherein said actuation device is configured for controlled opening and closing of said fluid channel, wherein said switching valve is provided in said controlled gas circuit for switching between a first state of said controlled gas circuit and a second state of said controlled gas circuit, wherein said switching valve is in said first switching state when said fluid valve is closed, wherein said switching valve is in said second switching state when said fluid valve is open, wherein, in said first state, said controlled gas circuit pre-loads an interior space of said container with a pressurization gas, wherein, in said a second state, said controlled gas circuit receives return gas that has been forced out of said respective container during filling thereof, wherein, in said first state, said controlled gas circuit has a first effective flow cross-section, wherein, in said second state, said controlled gas circuit has a second effective flow cross-section that is less than said first effective cross section, wherein said first and second gas channel sections are in parallel between a gas source and said closed gas space, wherein, in said first state, said first and second gas channel sections are both connected to said controlled gas circuit so that gas from said gas source flows through both said first gas channel section and said second gas channel section into said closed gas space, and wherein, in said second state, only one of said first and second gas channel sections is connected to said controlled gas circuit so that gas from said gas source flows through only one of said first and second gas channel sections.

2. The apparatus of claim 1, further comprising a choke disposed in one of said gas channel sections for reducing a flow cross-section thereof.

3. The apparatus of claim 1, wherein said switching valve comprises first and second outlet openings that are part of said controlled gas circuit, wherein a flow cross section of said first outlet opening is different from a flow cross section of said second outlet opening, wherein in said first switching state, said first outlet opening is open and said second outlet opening is closed, and wherein in said second switching state, said second outlet opening is closed and said first outlet opening is open.

4. The apparatus of claim 1, further comprising a gas pipe and a valve body, wherein said gas pipe extends from said fluid valve, wherein said gas pipe defines a gas channel that is separate and distinct from said first and second gas channel sections, wherein said valve body is disposed within said closed gas space, wherein said valve body is disposed such that said gas pipe operates as a tappet for said switching valve, and wherein said valve body is movable within said closed gas space along a filling element axis, and wherein movement of said gas pipe during opening and closing of said fluid valve causes said valve body to move along said filling element axis.

5. The apparatus of claim 4, wherein an inside face of said closed gas space defines a valve seat, wherein said valve body transitions between a first position and a second position in response to movement of said gas pipe, wherein in said first position, said valve body contacts said valve seat and thereby closes off one of said first and second gas channel sections and leaves open an other of said first and second gas channel section, and wherein, in said second position, said valve body is spaced from said valve seat and leaves open both said first and second gas channel sections.

6. The apparatus of claim 5, wherein said valve body is an annular structure having an opening that leads into said gas channel formed in said gas pipe, wherein said opening is disposed on a top face of said annular structure opposite said valve seat.

7. The apparatus of claim 6, wherein said valve body further comprises a wall that faces radially, said wall having a radial opening that leads to said into said gas channel formed in said gas pipe.

8. The apparatus of claim 7, wherein said second gas channel section has a smaller flow cross section than said first gas channel section, and wherein said second gas channel section comprises said radial opening.

9. The apparatus of claim 1, wherein said first and second gas channel sections open into said closed gas space at a point outside of said switching valve.

10. The apparatus of claim 1, further comprising a rotor that can be driven about a vertical machine axis, wherein said rotor has a periphery, and wherein said filling element, along with additional filling elements, is disposed around said periphery of said rotor.

* * * * *